United States Patent [19]

Wagner et al.

[11] 4,287,552

[45] Sep. 1, 1981

[54] ELECTROSTATIC SPRAY PISTOL

[75] Inventors: Josef Wagner, Friedrichshafen, Fed. Rep. of Germany; Willi Huber, Altstätten, Switzerland

[73] Assignee: J. Wagner AG, Fed. Rep. of Germany

[21] Appl. No.: 32,417

[22] Filed: Apr. 23, 1979

[30] Foreign Application Priority Data

Apr. 28, 1978 [DE] Fed. Rep. of Germany ..... 2818938

[51] Int. Cl.[3] ..... B05B 5/02

[52] U.S. Cl. ..... 361/228; 239/708

[58] Field of Search ..... 361/227, 228; 239/708, 239/706

[56] References Cited

U.S. PATENT DOCUMENTS

| | | | |
|---|---|---|---|
| 3,599,038 | 8/1971 | Skidmore | 317/3 |
| 3,608,823 | 9/1971 | Buschor | 239/15 |
| 3,731,145 | 5/1973 | Senay | 317/3 |
| 4,033,506 | 7/1977 | Braun | 239/708 |
| 4,120,016 | 10/1978 | Hendricks | 239/708 X |
| 4,120,017 | 10/1978 | Sickles | 239/708 X |
| 4,139,155 | 2/1979 | Hastings | 239/708 |
| 4,171,098 | 10/1979 | Braun | 239/708 |

FOREIGN PATENT DOCUMENTS

| | | | |
|---|---|---|---|
| 2533372 | 2/1976 | Fed. Rep. of Germany | 239/708 |

*Primary Examiner*—Harry E. Moose, Jr.
*Assistant Examiner*—L. C. Schroeder
*Attorney, Agent, or Firm*—Hill, Van Santen, Steadman, Chiara & Simpson

[57] ABSTRACT

An electrostatic hand-held spray gun with a body consisting of a barrel affixed at a selected angle to a handle. The barrel has a boring which terminates at an atomizer. The handle contains a boring which at a lower end terminates in a hose connection and at an upper end at a control valve. A second end of the barrel boring also terminates at the valve. The control valve is operable by a trigger rotatably affixed to the handle and controls the flow of color material through the boring in the barrel. A spray electrode is located adjacent the atomizer. A tubular trigger guard structure is located near the second end of the barrel in front of the trigger and is oriented at a selected angle with respect to the barrel. A high voltage cascade multiplier module and a step-up transformer module are removably mounted within the trigger guard. A low voltage cable brought into a lower end of the trigger guard provides power to drive the step-up transformer. The step-up transformer outputs an intermediate voltage, high frequency, signal to drive the high voltage multiplier circuitry. The output of the high voltage multiplier circuitry is connected by a conductor, through a current limiting resistor to the electrode adjacent the atomizer.

6 Claims, 2 Drawing Figures

ELECTROSTATIC SPRAY PISTOL

BACKGROUND OF THE INVENTION

1. Field of the Invention

The field of the invention pertains to electrostatic, hand-held, spray guns.

2. The Prior Art

Electrostatic spray guns are known from the prior art in which a high voltage generator is located in a cabinet at a distance from the gun. A high voltage cable, up to several meters long, connects the pistol body with the high voltage generator. This high voltage cable has several well recognized disadvantages due to the fact that the cable must of necessity be heavy and thick in order to properly insulate the high voltages, on the order of 70 to 90 kv, from the surrounding environment.

It has also been known in the prior art to incorporate the high voltage generation electronics in the pistol itself. In the prior art spray guns, the high voltage generating electronics, comprising usually a voltage multiplier formed of diodes and capacitors having an elongated shape, has either been located adjacent and coextensive to a boring through the pistol barrel through which the color material passes or, alternately, has been located so that it surrounds the boring through the barrel. It has also been recognized in the prior art that the high voltage multiplier section must be encapsulated in an appropriate potting compound for insulation purposes. Thus, the prior art pistols have been constructed with a barrel wherein the high voltage multiplier section has become permanently bonded thereto and an integral part thereof.

Typical prior art guns, wherein the high voltage diode capacitor multiplier electronics has been mounted in the gun, are disclosed in:

U.S. Pat. No. 3,599,038 to Skidmore,

U.S. Pat. No. 3,731,145 to Senay,

U.S. Pat. No. 3,608,823 to Buschor.

While the practice of encapsulating the high voltage generator system in the barrel of the pistol has advantages from the standpoint of the weight of the pistol and the costs of manufacture of it, there are also disadvantages which have been recognized which are inherent to this structure. One disadvantage is that with the high voltage generator system being an integral part of the barrel, it is impossible to repair a defect in the high voltage system. Thus, unless the barrel has been designed to be removable, the entire pistol must be replaced if the high voltage generator system fails.

If for some reason there is a failure in the color distribution system through the handle and barrel through which the color material passes, at the very least, once again the barrel structure including the high voltage generator system must be replaced. Further difficulties are encountered where it is desirable to house a number of color borings in the pistol barrel so that the gun might apply more than one color readily.

Additionally, it has been found that where the high voltage generator system has been located so as to be longitudinally adjacent to or to surround the boring through the barrel that difficulties occur in hot spraying. The heat transfer from the color boring through the voltage multiplier which due to the well known temperature dependency of semiconductors, degrades the performance of the high voltage multiplier structure.

Thus, there has been a need for a hand-held spray pistol with a high voltage generator system mounted in the pistol so that the generator system may be easily serviced or repaired, and may also be used with hot spraying techniques.

SUMMARY OF THE INVENTION

In accordance with the present invention, an electrostatic hand-held spray gun has a barrel affixed at an angle to a handle. A spray control trigger is pivotably mounted near the intersection of the barrel and the handle. An elongated, tubular, and hollow, trigger guard has an end affixed to the barrel of the gun near the handle such that the trigger guard is oriented at a convenient and selected angle with respect to the barrel of the pistol. The trigger mechanism operates a spray valve located between the handle of the spray gun and the trigger guard. A modular step-up transformer and a high voltage generator, of the capacitor-diode multiplier type, are removably housed in the trigger guard.

It is a further aspect of the invention that the electronics within the hollow trigger guard comprising the step-up transformer and the high voltage diode-capacitor multiplier are readily removable from the trigger guard by unscrewing a cap at a lower end of the trigger guard. The step-up transformer and the high voltage multiplier modules may then be extracted from within the trigger guard.

A low voltage cable is connected to the removable cap at the lower end of the trigger guard such that when the removable cap is affixed to the lower end of the trigger guard, low voltage, on the order of 10 volts at a frequency of approximately a 17 Khz, is applied to the input side of the step-up transformer. A connection is made between the output side of the step-up transformer and the input of the high voltage multiplier circuit. The high voltage end of the multiplier circuit makes contact with a conductor embedded in the barrel of the gun. This conductor is adjacent and parallel to the boring through the barrel. The conductor terminates at the spray electrode in the vicinity of an atomizer at the front of the barrel of the gun. For safety purposes, a current limiting resistor may be located in series with the conductor between the high voltage output of the diode-capacitor multiplier structure and the spray electrode.

Locating the high voltage multiplier and its related step-up transformer removably in the trigger guard improves the serviceability of the pistol in that a defective high voltage generator may be readily replaced. Similarly, if the paint spray distribution system within the pistol becomes defective or inoperative, the electronics may be removed from the pistol and used in another pistol.

The handling characteristics of the pistol are substantially improved by locating the high voltage multiplier and its associated step-up transformer in the trigger guard as opposed to along the barrel. The shift in weight back toward the operator's hand substantially reduces fatigue and improves the ease of use and maneuverability of the pistol.

A magnetic proximity switch is located in the trigger guard housing and senses a movement of the trigger to open or close the valve which controls the color distribution system. When the movement of the trigger is sensed, the proximity switch opens or closes. The proximity switch controls the application of the input voltage to the step-up transformer. By switching the power to the step-up transformer, the light voltage multiplier circuit is also switched on and off. Thus, the application of the high voltages 70–90 kilovolts to the spray electrode is easily controlled.

A further aspect of the invention resides in the removable mounting of the modular high voltage electronics in the handle of the gun or external to the barrel of the gun.

DETAILED DESCRIPTION OF THE PREFERRED EMBODIMENTS

Figure 1:
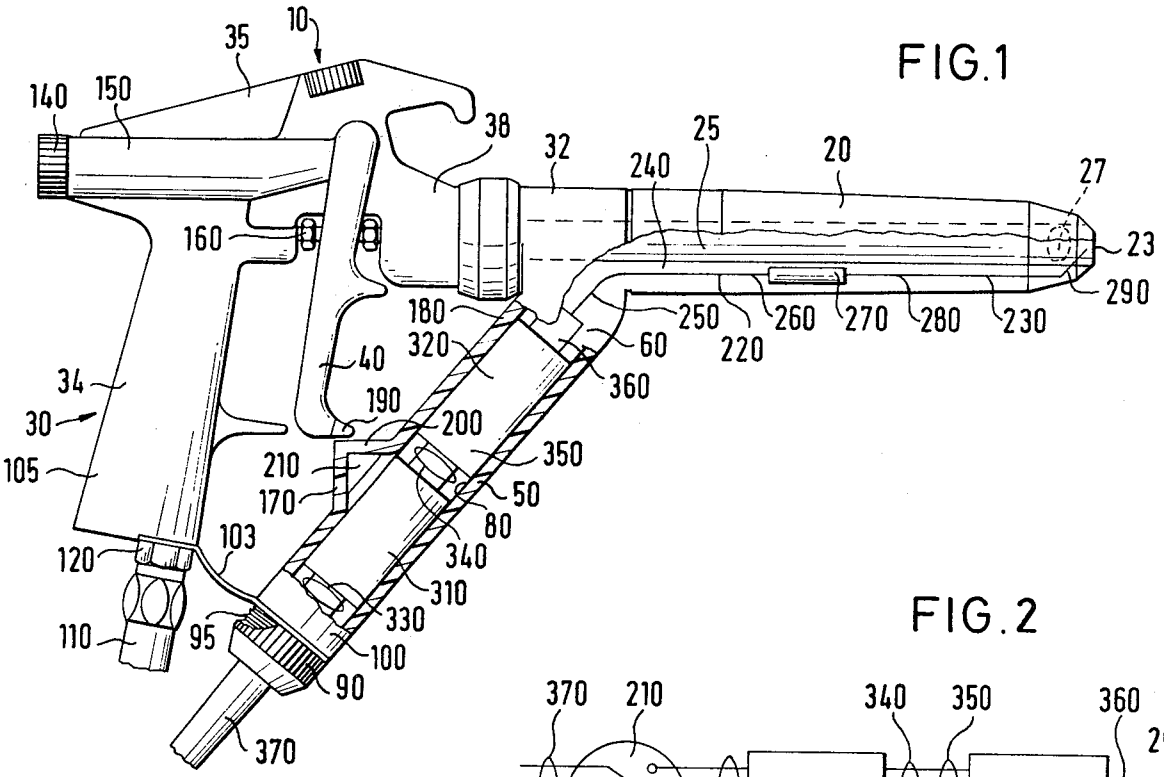
FIG. 1 is an elevation, partially broken away to show the internal structure, of a hand-held spray pistol incorporating the present invention.
Figure 2:
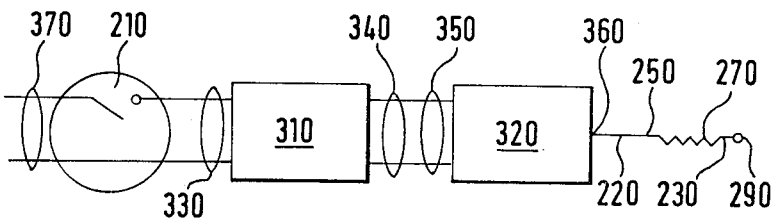
FIG. 2 is a schematic diagram of the electronics in the hand-held spray gun of FIG. 1.

Not for the purpose of limitation, but for the purpose of disclosing the best mode of practicing our invention, and to enable one skilled in the art to practice our invention, there is shown in FIGS. 1 and 2 one embodiment of our invention.

FIG. 1 is a side view of an improved electrostatic spray gun 10 partly broken away to show the internal construction of the gun. The improved electrostatic spray gun 10 has a barrel 20 with a spray output opening 23. A bore or passageway 25, interior to the barrel 20, terminates at an atomizer 27 adjacent the opening 23. The passageway 25 provides a path in which the color material to be applied travels within the barrel 20 to the atomizer 27. The barrel 20 is connected to a housing 30 at an end 32. The housing 30 has a handle 34, an upper portion 35 and a connector 38 to which the end 32 of the barrel 20 is removably affixed. A trigger 40 is rotatably mounted to the upper region 35 of the housing 30. A tubular trigger guard 50 is affixed at a first end 60 to the end 32 of the barrel 20. The trigger guard 50 is hollow having a boring 80 therethrough with a removable cap 90 affixed by a set of threads 95 to a second end 100. A bracket 103 mechanically connects the end 100 of the trigger guard 50 to an end 105 of the handle 34.

A line 110 for supplying color material to the pistol 10 is affixed at a connection 120 to the lower end 105 of the handle 34. If desired, a compressed air line may be affixed at a connection 140 at an end 150 of the upper region 35 of the housing 30.

The connection within the pistol 10 between the color supply input 120 and the compressed air supply brought in through the connection 140 to the housing 30 is of a conventional variety and forms no part of the present invention. As is also conventional, the trigger 40 is operable to control a valve 160 for the purpose of turning the color supply on or off.

The trigger guard 50 has a triangular shaped housing 170 affixed to a surface 180. The surface 180 is adjacent the trigger 40. A metal end 190 of the trigger 40 is located adjacent a side 200 of the triangular housing 170. Within the triangular housing 170 is located a proximity switch 210 of a conventional type which is operable to detect the presence or absence of the metal end 190 of the trigger 40. A manual rotation of the end 190 of the trigger 40 away from or toward the triangular housing 170 will open or close the proximity switch 210.

Embedded in the barrel 20 of the pistol 10 and extending longitudinally along the bottom thereof is a first conductor 220 and a second conductor 230. The first conductor 220 has an end 240 which terminates adjacent to the first end 60 of the trigger guard 50. A short conducting extension 250 rigidly affixed within the first end 60 of the trigger guard 50 makes contact with the end 240 of the conductor 220. The conductor 220 has a second end 260 which makes contact with a current limiting resistor 270 also embedded within the barrel 20 of the housing 10. The conductor 230 has a first end 280 which completes the connection to the resistor 270 and has a second end 290 which forms a paint spray electrode adjacent the atomizer 27 near the end of the paint material transporting passage 25 and also near the paint output end 23 of the barrel 27.

The selection of the value of the resistor 270, whose purpose is to function as a current limiter to suppress arcing, is well known to those in the art, and the actual value of the resistor forms no part of the present invention.

Removably mounted within the trigger guard 50 is a step-up transformer module 310 mounted adjacent a high voltage diode-capacitor multiplier circuit module 320. The step-up transformer has a low voltage input 330, and a high voltage output 340. The high voltage output 340 of the step-up transformer 310 is connected to an input end 350 of the diode-capacitor multiplier circuitry 320. A high voltage direct current output end 360 of the multiplier 320 is in contact with the embedded conductor 250 located at the first end 60 of the trigger guard 50.

The low voltage input end 330 of the step-up transformer 310 is connected via the proximity switch 210 to a low voltage input cable 370 which is affixed to the removable cap 90 at the second end 100 of the trigger guard 50.

Both the step-up transformer 310 and the high voltage multiplier circuit 320 may be removed from the boring 80 of the trigger guard 50 once the cap 90 has been removed from the second end 100.

A typical input voltage which might be supplied on the low voltage cable 370 is 10 volts at an input frequency of 17,000 Hz. This signal is stepped up to some convenient intermediate AC voltage on the order of 4500 volts, still at 17,000 Hz by the step-up transformer 310 and then is converted by the multiplier circuitry 320 to an output voltage at the high voltage output 360 on the order of 70 to 90 kv. The 70 to 90 kv is then delivered through the conductor 220, the resistor 270 and the conductor 230 to the paint spraying electrode 290.

FIG. 2 is a block diagram schematic of the electronic circuitry housed within the gun 10 of FIG. 1. The 10 volt 17 Khz signal is brought in via the cable 370 to the proximity switch 210. The output of the proximity switch 210 switches the input 330 to the step-up transformer 310. The output 340 of the step-up transformer 310 is connected to the input 350 of the high voltage multiplier circuit 320. The high voltage output line 360 from the high voltage multiplier circuitry 320 is then connected through the conductors, 250, 220, the resistor 270, and the conductor 230 to the paint spraying electrode 290.

Since the step-up transformer 310 and the high voltage multiplier circuit 320 are both located within the trigger guard 50, the high voltage electronics are effectively isolated from the color distribution system within the housing 30 and barrel 20 of the gun 10. Thus, if hot paint is pumped through the color distribution boring 25, there will be no undesirable temperature variations communicated to the high voltage electronics 320. Further, the location of the trigger guard at the end 32 of the barrel 20 extending backwards toward the handle 34 improves the handling characteristics of the gun 10. Since the barrel 20 now is substantially lighter than in the prior art guns and since the trigger guard 50 is adjacent the handle 34, the center of gravity or center of rotation of the gun 10 is now located very close to the operator's hand. This results in minimal operator fatigue when using the gun 10 for long periods of time.

In some applications it might be desirable to locate the step-up transformer 310 outside of the gun 10. In such a case the benefits of the invention are still obtained in that the high voltage multiplier 320 can still be removably located within the trigger guard 50. In this embodiment, the voltage brought to the lower end 100 of the trigger guard 50 is higher than in the preferred embodiment of FIGS. 1, 2. It might be on the order of 3–5,000 volts. However, as is recognized by those skilled in the art, this is still a relatively low input voltage compared with the 70–90 kilovolts applied to the spray electrode 290.

It should be further noted that the benefits of the present invention are obtained no matter what frequency signal is input to the relatively low voltage end 350 of the multiplier 320.

Additionally, the modular step-up transformer and diode-capacitor multiplier circuit might be located in the handle 34 or external to the barrel 20. The housing 30 may be a standard Wagner airless spray gun housing to which the modular high voltage generator 320 and modular step-up transformer 310 are attached.

The step-up transformer module 310 along with its associated connections 330, 340 could be considered as a means for electrical conduction linking a switch means 210 to a low voltage end 350 of the diode-capacitor multiplier module.

While various suggestions, modifications, or equivalent structures might be suggested by those skilled in the art, it should be understood that we wish to embody within the claims of the patent warranted hereon all such suggestions, modifications or equivalent structures as reasonably come within our contribution to the art.

We claim as our invention:

1. An improved electrostatic manual spray gun having a barrel and a housing with a handle, the barrel being affixed at a proximal end to one end of the housing at an angle with respect to the handle; a distribution system for the material to be sprayed within the housing being operably connected to a boring through the barrel and having a manually operable trigger rotatably affixed to the housing; the trigger being operable to control the flow of material to be applied through the housing and barrel and having further circuitry including a high voltage multiplier circuit mounted on the gun operably connected to a spray electrode located adjacent a distal end of the boring in the barrel; the improvement comprising:

removable connection means interposed between the one end of the housing and the proximal end of the barrel to removably attach the barrel to the housing;

a hollow trigger guard spaced apart from the distribution system and from the boring through the barrel, said trigger guard has a first end fixedly connected to the proximal end of the barrel of the spray gun, and a second end removably affixed to a lower end of the handle of the spray gun; said high voltage multiplier circuit being modular and removably mounted within said trigger guard;

a relatively low voltage input cable affixed to said second end of said trigger guard and connected by electrical means for conduction to said high voltage multiplier module;

switch means cooperating with said electrical means, to selectively apply, under manual control, a selected input signal to a low voltage input end of said high voltage multiplier module, whereby said gun may be used to apply hot material without degrading the electrical characteristics of said high voltage multiplier module.

2. The improved electrostatic spray pistol according to claim 1 wherein said means for electrical conduction includes a step-up transformer module removably mounted in said trigger guard and operatively connected to said low voltage input cable and a low voltage input to said high voltage multiplier module.

3. The improved electrostatic spray pistol according to claim 2 wherein said trigger guard is oriented at a selected acute angle with respect to the handle.

4. The electrostatic spray gun according to claim 1 wherein said switch means and said electrical means connected to said low voltage end of said multiplier circuit comprise:

a proximity switch and a step-up transformer module; said proximity switch being removably connected in series with a low voltage input side of said step-up transformer module and being further removably connected to said low voltage input cable, a high voltage output side of said step-up transformer being removably connected to said low voltage input to said multiplier circuit; whereby said proximity switch is operable to switch the relatively low voltage to said low voltage input side of said transformer on or off depending on the location of said manually rotatable trigger.

5. For use with a paint spray gun handle with a material delivery path therethrough and a trigger controlled valve located to open and close the delivery path, an electrostatic attachment comprising:

an elongated barrel with a proximal and a distal end and a material delivery opening therethrough, a paint spray electrode is attached to said distal end;

connection means attached to said proximal end to connect the handle to said barrel so as to align an end of the material delivery path through the handle with a proximal end of said material delivery opening in said barrel;

a tubular, rigid, trigger guard with first and second ends, said first end is fixedly attached to said barrel adjacent said proximal end and said second end is removably connectable to a lower end of the handle;

high voltage generation means removably located within said trigger guard and connected by electrical means enclosed within said trigger guard and said barrel to said paint spray electrode;

whereby hot materials may be applied by an electrostatic gun formed by connecting the handle to said electrostatic attachment without degrading the electrical characteristics of said high voltage generation means.

6. In an electrostatic spray gun having a barrel and a housing with a handle, the barrel is affixed at a proximal end to one end of the housing at an angle with respect to the handle; a distribution system for the material to be sprayed within the housing being operably connected to a boring through the barrel and having a manually operable trigger rotatably affixed to the housing; the trigger being operable to control the flow of material to be applied through the housing and barrel and having further circuitry including a high voltage multiplier circuit mounted on the gun operably connected to a spray electrode located adjacent a distal end of the boring in the barrel; an improvement comprising:

a hollow trigger guard spaced apart from the distribution system within the housing and from the boring through the barrel, said trigger guard has a first end affixed to the proximal end of the barrel of the spray gun;

said high voltage multiplier circuit is modular and removably mounted within said trigger guard;

a relatively low voltage input cable is affixed to a second end of said trigger guard and connected by electrical means for conduction to said high voltage multiplier module;

switch means cooperating with said electrical means, to selectively apply, under manual control, a selected input signal to a low voltage input end of said high voltage multiplier module, whereby said gun may be used to apply hot material without degrading the electrical characteristics of said high voltage multiplier module.

* * * * *

UNITED STATES PATENT AND TRADEMARK OFFICE

CERTIFICATE OF CORRECTION

PATENT NO. : 4,287,552

DATED : September 1, 1981

INVENTOR(S) : Josef Wagner et al

It is certified that error appears in the above—identified patent and that said Letters Patent is hereby corrected as shown below:

On the front page of the patent, Item No. [73], change

"Assignee: J. Wagner AG, Fed. Rep. of Germany" to
--Assignee: J. Wagner AG, Altstätten, Switzerland--.

Signed and Sealed this

*Twenty-sixth* Day of *January 1982*

[SEAL]

*Attest:*

GERALD J. MOSSINGHOFF

*Attesting Officer*

*Commissioner of Patents and Trademarks*